US005261614A

United States Patent [19]

Schwelling

[11] Patent Number: 5,261,614

[45] Date of Patent: Nov. 16, 1993

[54] PAPER SHREDDER WITH MATERIAL CONVEYOR

[76] Inventor: Hermann Schwelling, Hartmannweg 5, D-7777 Salem 2, Fed. Rep. of Germany

[21] Appl. No.: 827,353

[22] Filed: Jan. 29, 1992

[30] Foreign Application Priority Data

Jan. 29, 1991 [DE] Fed. Rep. of Germany ..... 4102486

[51] Int. Cl.[5] ..... B02C 7/06

[52] U.S. Cl. ..... 241/167; 241/223; 241/236; 83/114

[58] Field of Search ..... 241/223, 236, 166, 167; 83/114, 500; 198/835, 845, 846, 847

[56] References Cited

U.S. PATENT DOCUMENTS

| | | | |
|---|---|---|---|
| 920,869 | 5/1909 | Hiss | 241/223 |
| 979,200 | 12/1910 | Prosser | 198/847 X |
| 1,224,960 | 5/1917 | Saecker | 241/223 X |
| 1,484,248 | 2/1924 | Austin | 198/847 |
| 1,855,808 | 4/1932 | Schwan | 198/847 |
| 2,439,520 | 4/1948 | Miller | 198/835 X |
| 2,736,205 | 2/1956 | Dunne, Jr. | 198/835 X |
| 3,186,536 | 6/1965 | Hinchcliffe | 198/846 |
| 3,331,491 | 7/1967 | East | 198/835 |
| 3,807,246 | 4/1974 | McIllwain | 198/835 |
| 4,018,392 | 4/1977 | Wagner | 241/223 X |
| 4,913,360 | 4/1990 | Lane et al. | 241/223 |

*Primary Examiner*—Eugenia Jones
*Assistant Examiner*—Raymond D. Woods
*Attorney, Agent, or Firm*—Anderson Kill Olick & Oshinsky

[57] ABSTRACT

A paper shredder includes a cutting unit with cutting rollers and a feed table arranged in front of the cutting unit. A conveyor belt for waste material or paper to be comminuted is mounted in the feed table. The conveyor belt extends into an intake gap of the cutting roller. The front end of the conveyor belt formed by a guide roller is mounted spaced from stripping members of the cutting rollers and this distance is bridged by a guide unit for the waste material or paper.

1 Claim, 2 Drawing Sheets

PAPER SHREDDER WITH MATERIAL CONVEYOR

BACKGROUND OF THE INVENTION

1. Field of the Invention

The present invention relates to a paper shredder including a cutting unit with cutting rollers and a feed table arranged in front of the cutting unit. A conveyor belt for the waste material or paper to be comminuted is mounted in the feed table. The conveyor belt extends into the region of an intake gap of the cutting rollers.

2. Description of the Related Art

A paper shredder as described above has long been known in the art. In fact, a number of devices of this type have been introduced by myself and by manufacturers of comparable systems.

However, these known constructions have various disadvantages. Thus, during operation, when a large amount of material to be cut is introduced, the latter penetrates in the region of the transfer area from the conveyor belt to the cutting unit into the gap between the stripping block and the cutting block and is jammed in this gap. Moreover, particularly when the rollers rotate in the opposite direction, there is the danger that notebook brackets or other previously comminuted metal parts are pressed at an obtuse angle against the conveyor belt and damage or even destroy the conveyor belt.

SUMMARY OF THE INVENTION

Therefore, it is the object of the present invention to improve a paper shredder of the above-described type in such a way that during forward and rearward rotation of the rollers, the material to be cut is always transferred without problems from and to the conveyor belt.

In accordance with the present invention, the front end of the conveyor belt formed by a guide roller is mounted spaced from stripping members of the cutting rollers and this distance is bridged by a guide unit for the waste material.

The various features of novelty which characterize the invention are pointed out with particularity in the claims annexed to and forming a part of this disclosure. For a better understanding of the invention, its operating advantages attained by its use, reference should be had to the drawing and descriptive matter in which there are illustrated and described preferred embodiments of the invention.

DESCRIPTION OF THE PREFERRED EMBODIMENTS

Figure 1A:
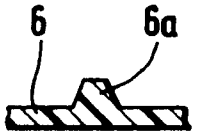
FIG. 1*a* is a partial sectional view of the conveyor belt.
Figure 1:
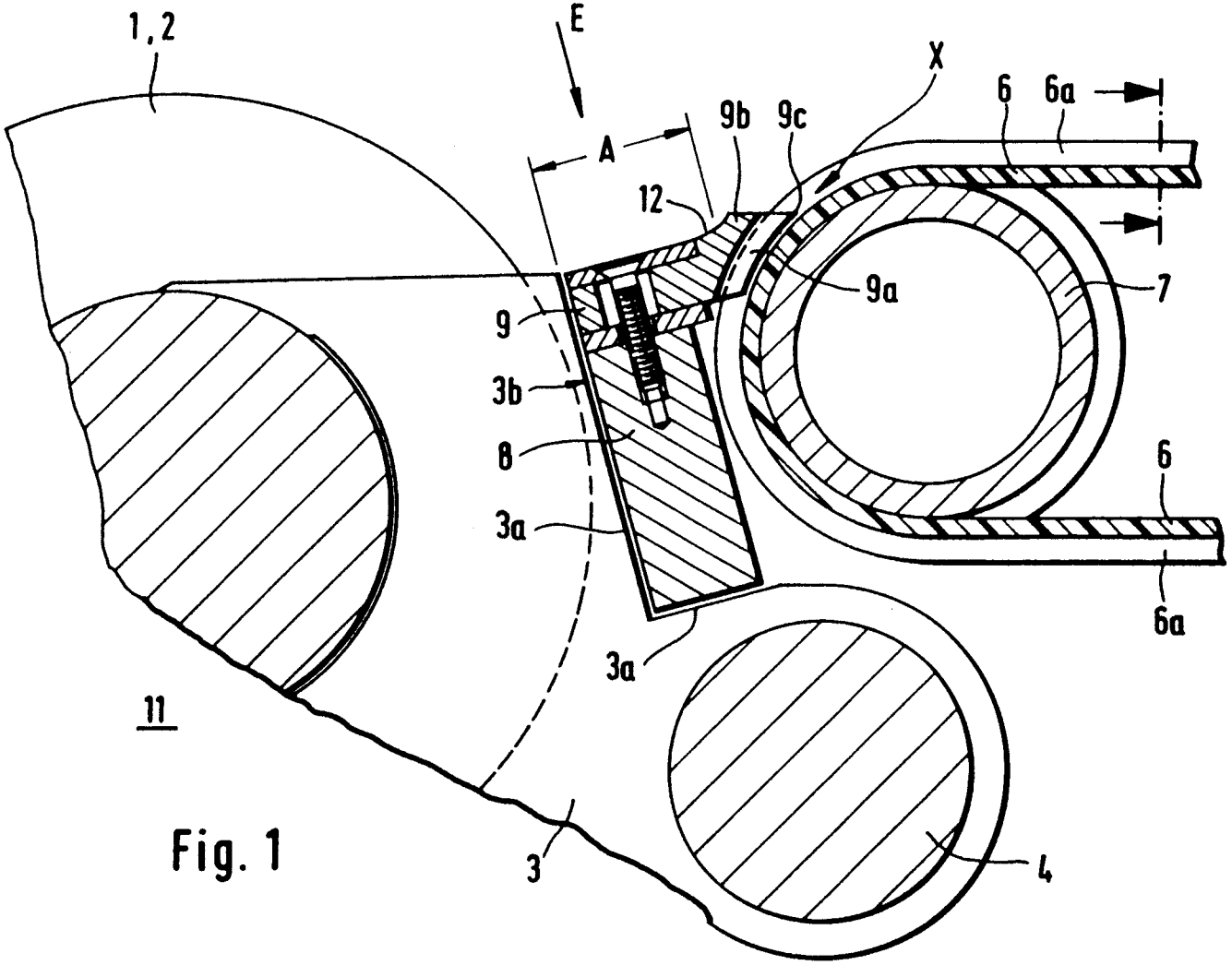
FIG. 1 is a partial schematic sectional view of the transition area of the paper shredder according to the present invention.
Figure 2:
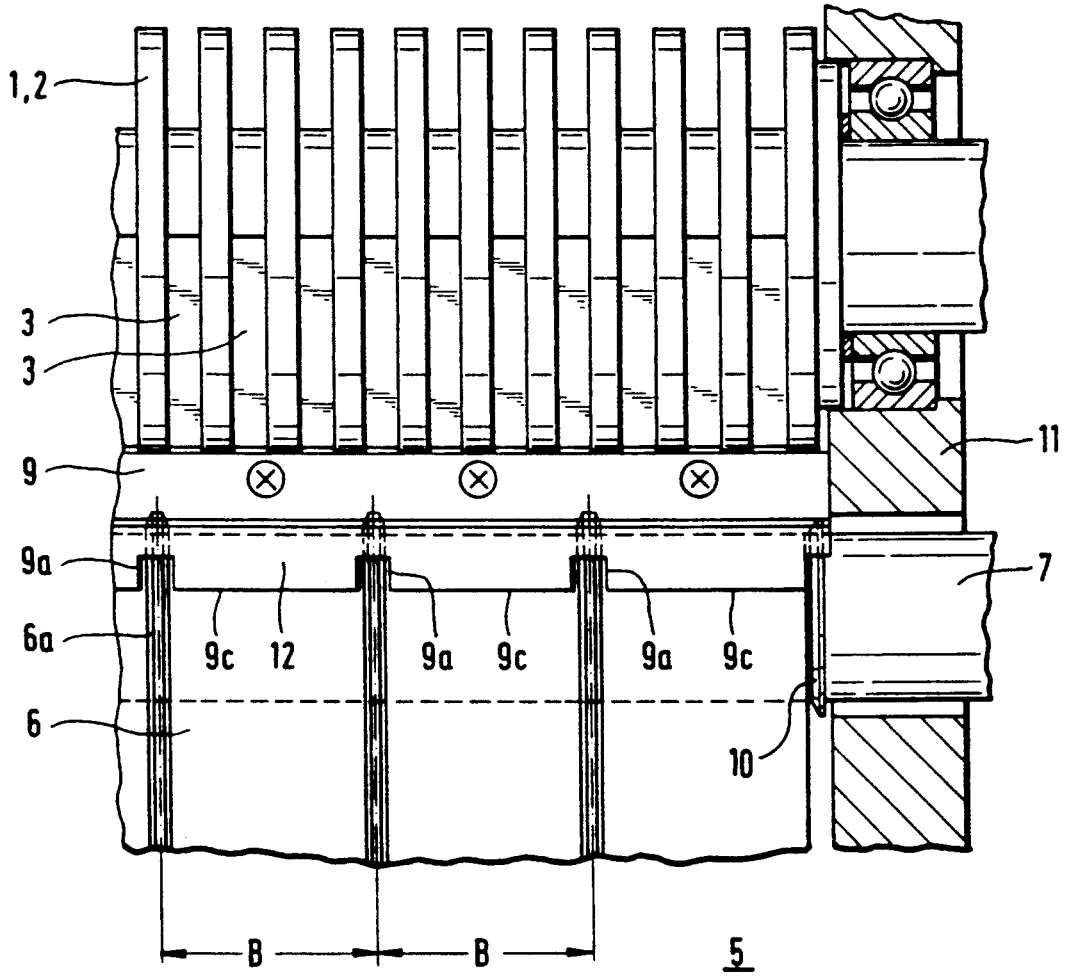
FIG. 2 is a partial top view, on a smaller scale, of the paper shredder of FIG. 1.

The paper shredder illustrated in FIGS. 1 and 2 of the drawing includes a cutting unit with a pair of cutting rollers 1 and 2. The cutting unit further includes stripping members 3 and support rods 4 extending through recesses 3*a* of the stripping members 3. A feed table 5 for receiving the material to be comminuted or shredded is arranged in front of the cutting unit. A motor-driven conveyor belt 6 is mounted on the feed table 5. The conveyor belt 6 reaches into the region of the intake gap E for the material to be shredded.

In order to meet the above-described object in an optimum manner, the present invention provides as a novel feature in the paper shredder that the front end of the conveyor belt 6, 6*a* at the guide roller 7 is arranged at a distance A from the stripping members 3 of the cutting rollers 1 and 2 and that this distance A is bridged by a guide unit 8, 9 for the material to be shredded.

In accordance with a specific structural feature of the invention, particularly the conveyor belt 6 has on its upper surface longitudinal ribs 6*a* which are arranged spaced apart at a distance B. In addition, the actual material guide member 9 of the guide unit 8, 9 has in the region of these longitudinal ribs 6*a* comb-like recesses 9*a*. Simultaneously, the projecting portions 9*b* located between the longitudinal ribs 6*a* extend with the tips 9*c* thereof in the manner of a peeling edge tangentially closely against the upper conveyor portion X or rest on the surface of the conveyor belt.

The features described above ensure that the tips or peeling edges 9*c* engage under the material to be shredded which rests on the longitudinal ribs 6*a* and that, therefore, in the transition area E the material cannot penetrate or be forced into the gap between the stripping unit 3 and the cutting block during forward rotations and during rearward rotation of the rollers.

In accordance with another important development of the invention, centering flanges 10 are provided at both ends of at least the forward guide roller 7 for obtaining an exact lateral guidance of the longitudinal ribs 6*a* of the conveyor belt 6 in the recesses 9*a* of the material guide member 9, wherein the comb-like material guide member 9 to 9*c* is releasably connected to the transverse support member 8 which is fastened in lateral bearing plates 11 of the cutting unit.

In order to obtain a cutting unit which is structurally compact, the present invention further provides that rear portions 3*b* of the stripping members 3 have a recess 3*a* which corresponds to the cross-section of the transverse support member 8 and that the upper side of the material guide member 9 has an additional inclined surface or stop cam 12 for conducting away any solidified material strands from the surface of the conveyor belt 6, 6*a* when the cutting rollers are rotated rearwardly. This feature also safely ensures that comminuted sharp metal objects, such as, notebook brackets or the like, are not pressed at an obtuse angle against the conveyor belt and do not damage or destroy the surface of the conveyor belt.

For reasons of strength, it is advantageous if the transverse support member 8 is of steel and the material guide member 9—9*c* is of wear-resistant plastic material.

While specific embodiments of the invention have been shown and described in detail to illustrate the inventive principles, it will be understood that the invention may be embodied otherwise without departing from such principles.

I claim:

1. A paper shredder, comprising:

a cutting unit including cutting rollers defining a cutting roller intake gap for a waste material to be comminuted, stripping members having an upstream portion, and lateral bearing plates;

a feed table upstream of the cutting unit;

a conveyor belt supported on the feed table and pointing into the intake gap, wherein said conveyor belt has an upper surface with longitudinal ribs arranged thereon in a spaced relationship to each other;

a guide roller forming a downstream boundary of the conveyor belt and located upstream of the stripping members of the cutting unit; and a waste material guide unit bridging a spaced region between the guide roller and the stripping members, the guide unit comprising:

a transverse beam attached to the lateral bearing plates of the cutting unit and extending across an entire cutting unit width, wherein said transverse beam has a cross-section matching to a cross-section of a recess in the upstream portion of the stripping plates; and a material guide member detachably supported on the transverse beam, wherein said material guide member has:

comb-like recesses in regions of the longitudinal ribs;

projecting portions located between the longitudinal ribs and having tips which extend tangentially closely against the upper surface of the conveyor belt;

an upper side; and a surface on the upper side inclined relative to the upper surface of the conveyor belt for conducting any solidified material strands away from the upper surface of the conveyor belt when the cutting rollers rotate in a backwardly direction.

* * * * *